United States Patent [19]

Gottsmann et al.

[11] 4,215,944

[45] Aug. 5, 1980

[54] SINGLE KEYLEVER MULTIPLE ACTION CONTROL FOR TYPEWRITERS

[75] Inventors: Helmut Gottsmann; Günter Scheinpflug, both of Nuremberg, Fed. Rep. of Germany

[73] Assignee: Triumph Werke Nurnberg A.G., Nuremberg, Fed. Rep. of Germany

[21] Appl. No.: 898,956

[22] Filed: Apr. 21, 1978

[30] Foreign Application Priority Data

May 10, 1977 [DE] Fed. Rep. of Germany ..... 2720963

[51] Int. Cl.[2] ..... B41J 5/28

[52] U.S. Cl. ..... 400/314; 400/186; 400/372

[58] Field of Search ..... 400/185, 186, 314, 317, 400/314.1, 370–374, 314.6

[56] References Cited

U.S. PATENT DOCUMENTS

| | | | |
|---|---|---|---|
| 2,170,696 | 8/1939 | Rhodes | 400/314 |
| 2,258,213 | 10/1941 | Michelsen | 400/314 |
| 2,540,031 | 1/1951 | Hazleton | 400/230 |
| 3,373,859 | 3/1968 | Oliver | 400/372 |
| 3,882,987 | 5/1975 | Link | 400/372 |

*Primary Examiner*—William Pieprz

*Attorney, Agent, or Firm*—Joseph R. Spalla

[57] ABSTRACT

A typewriter having a carriage return line indexing key to initiate in parallel a powered carriage return and a powered line indexing operation is provided with linkage associated with the carriage return action which assures initiation of the line indexing operation should the keylever depression be sufficient to initiate a carriage return operation but insufficient to initiate the line index operation.

2 Claims, 2 Drawing Figures

Fig_1
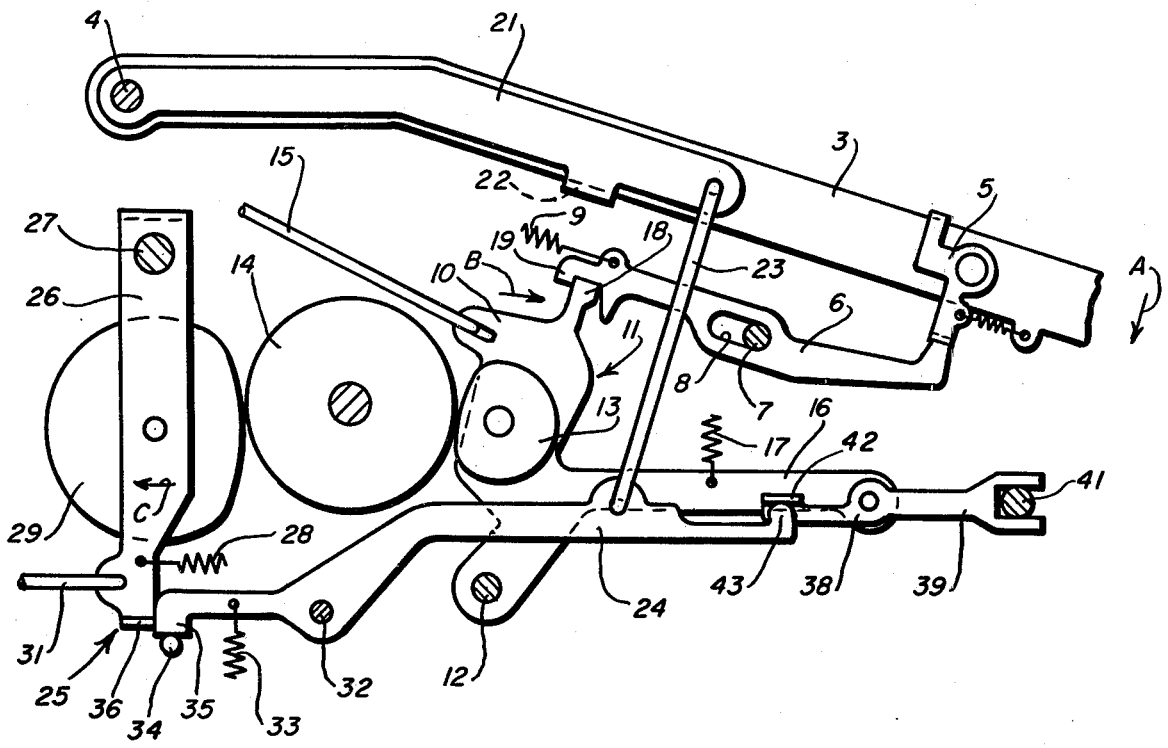
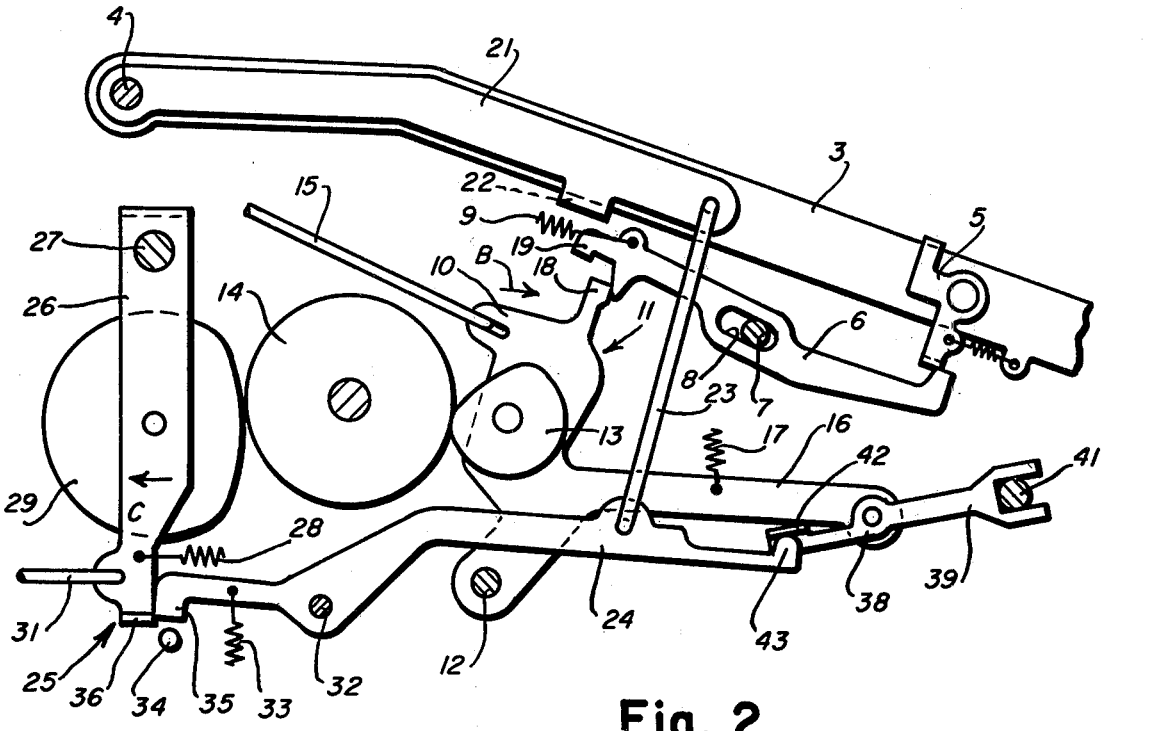
Fig_2

SINGLE KEYLEVER MULTIPLE ACTION CONTROL FOR TYPEWRITERS

This invention relates to typewriters having a carriage return line indexing keylever operable on parallel linkage to initiate the carriage return and line indexing functions; more particularly, it relates to a typewriter having a connection whereby the initiation of the carriage return function will initiate the line indexing function in the event depression of the keylever is insufficient to initiate the parallel line index function.

In machines where two actions are initiated through parallel linkages by a common keylever, it is possible where adjustments are not correct, that the keylever depression though sufficient to initiate one action will be insufficient to initiate the second action.

In accordance with the present invention, further linkage is provided which is driven by the first initiated action to positively initiate the second in the event the second was not directly initiated by the keylever.

An object of the invention, therefore, is to provide mechanism to assure that both functions to be initiated by a single keylever depression are initiated in series if depression of the keylever is insufficient to initiate them through parallel linkage.

Other objects, features and advantages of the present invention will become apparent to those skilled in the art from a reading of the following detailled description wherein like reference numerals designate like or corresponding parts throughout the views, and wherein:

FIG. 1 is an elevational view showing the elements of the invention in rest position; and FIG. 2 is a view similar to FIG. 1 showing the elements in active positions.

Referring now to the drawing, there is shown in FIGS. 1 and 2 a carriage return keylever 3 which is pivotally mounted on a frame supported rod 4. The keylever 3 carries a control pawl 5 which normally overlies a two-armed release lever 6 which is pivotally supported about a frame supported crossrod 7 received within an oblong slot 8 in the release lever to permit translatory movement of the release lever 6 relative to the rod 7. A spring 9 is connected to pull the two-armed release lever 6 rearwardly to the extent permitted by the rod 7 to a rest position.

Release lever 6 cooperates with a drive lever 10 of a powered carriage return action generally designated by reference numeral 11. The drive lever 10 is pivoted on a frame supported rod 12 and carries rotatably mounted drive cam 13 for association with a constantly rotating power roll 14 thereby to drive the drive lever 10 clockwise in a known manner. A tie rod 15, connected to the drive lever 10, is also connected to a carriage return coupling (not shown) to actuate the latter when the drive lever 10, driven by the cam 13, performs a pivotal clockwise motion about pivot rod 12.

The drive lever 10 is also equipped with a forwardly extending arm 16 to which a return spring 17 is connected to bias the drive lever 10 counterclockwise in the direction of the power roll 14. By means of a catch 18 on the drive lever 10 which is normally engaged by a hooked end 19 of the two-armed release lever 6, the drive lever 10 is held from movement toward the power roll 14.

As illustrated, there is also parallel linkage comprising a lever 21 pivotally mounted about rod 4 directly adjacent to the keylever 3. Lever 21 has a bent-off lug

22 which underlies keylever 3. A connecting link 23 connects lever 21 with a release lever 24 of a powered line indexing action generally designated by reference numeral 25.

The powered line indexing action 25 comprises a drive lever 26 pivotally supported at its upper end on a frame mounted pivot rod 27 and biased counterclockwise toward the power roll 14 by a spring 28. The drive lever 26 carries a rotatably mounted cam 29 for engagement with the power roll 14 and is connected by link 31 to line indexing mechanism (not shown).

Release lever 24 is pivotally mounted about a rod 32 and is under the influence of an extension spring 33 which normally holds the release lever 24 against a stop 34 with a nose 35 of the release lever 24 positioned in the path of a bent-off end 36 of the drive lever 26 to hold it from movement toward the power roll 14 by return spring 28.

For further details of the above-described mechanism, reference may be had to the Service Manual for the ROYAL 5000 Electric Typewriter, copyrighted 1975 by the Royal Typewriter Company Division of Litton Industries.

In the above-described mechanism, the carriage return keylever 3 can sometimes be depressed sufficiently to initiate a carriage return action 11 but insufficient to effect; the release and initiation of the line indexing action 25.

To overcome this problem, the drive lever 10 of the carriage return action is, in accordance with the invention, formed, on its forwardly extending arm 16, to rotatably support a link 38 whose forward end 39 is forked to embrace a pivot rod 41. The rearward end of link 38 has a bent-off portion 42 which overlies an extension 43 of the release lever 24.

In operation, upon depression of the carriage return keylever 3 in the direction of arrow A, release lever 6 is pivoted clockwise by means of the pawl 5. This releases the hooked end 19 thereof from the catch 18 of the drive lever 10 whereby the action of spring 17 is released. This causes the drive cam 13 to come into contact with the power roll 14 whereby the drive lever 10 is pivoted in the direction of arrow B. Also, upon activation of keylever 3, lever 21 thereadjacent is also pivoted to effect substantially simultaneously through link 23 the movement of the release lever 24 to initiate a line space indexing operation by releasing the line indexing action for movement toward the power roll 14. As noted before, the latter operation may fail to occur if the keylever 3 is depressed only just far enough to release drive lever 10 but insufficient to release drive lever 26. In such event, the movement of the drive lever 10 in the direction of arrow B will cause link 38 to pivot about rod 41 fixed to the frame with the result that end 42 presses on the extension 43 of the release lever 24 moving it clockwise against the action of its biasing spring 33 sufficiently to effect release of the drive lever 26 to the action of its return spring 28 to inititate the line indexing action. The cam thereof then causes drive lever 26 to pivot in the direction of arrow C so that its tie rod can effect a line space movement. The line indexing action is thus positively connected with the carriage return action so that the release of the former is reliably effected. In specific devices through proper design of link 38, favorable motion sequences can be provided as may allow the elimination of the lever 21 and its associated connecting link 23.

The invention claimed is:

1. In a typewriter having a power roll, a cam drivable carriage return action, a cam drivable line indexing action, means biasing said actions toward engagement with and for driving engagement by said power roll, first and second rotatable latch means for respectively releasably holding said carriage return and line indexing actions from engagement with said power roll, a carriage return line indexing keylever, and linkage associated with said keylever for rotating said first latch means to release said carriage return action upon depression of said keylever; the improvement comprising a motion transfer link rotatably connected intermediate its ends to said cam driven carriage return action, means supporting one end of said motion transfer link about a fixed pivot, and an offset on the opposite end of said motion transfer link overlying said second latch means and operative to rotate said second latch means to release said line indexing action incident to driving motion of said carriage cam action.

2. In a typewriter having a power roll, a cam driven carriage return action and a cam driven line indexing action, means biasing said actions toward engagement with and for driving engagement by said power roll, first and second rotatable latch means for respectively releasably holding said carriage return and line indexing cam action from engagement with said power roll, a carriage return line feed keylever and parallel linkage associated with said carriage return line indexing keylever for rotating said first and second latching means to substantially simultaneously release both said carriage return and line indexing actions upon depression of said keylever; the improvement comprising a motion transfer link rotatably connected intermediate its ends to said cam driven carriage return action, means pivotably supporting one end of said link, and an offset on the opposite end of said link directly overlying said second latch means and operative to rotate said second latch means by said cam driven carriage return action in the event of failure of said parallel linkage to do so.

* * * * *